US006145758A

United States Patent [19]

Ogi et al.

[11] Patent Number: 6,145,758

[45] Date of Patent: Nov. 14, 2000

[54] VARIABLE ARC SPRAY NOZZLE

[75] Inventors: Jeffrey M. Ogi, Rancho Cucamonga; Steven Phan, Garden Grove; Matthew Payne, Chino Hills, all of Calif.

[73] Assignee: Anthony Manufacturing Corp., Azusa, Calif.

[21] Appl. No.: 09/374,670

[22] Filed: Aug. 16, 1999

[51] Int. Cl.[7] ..... B05B 1/32

[52] U.S. Cl. ..... 239/457; 239/514; 239/600; 239/DIG. 1

[58] Field of Search ..... 239/456, 457, 239/458, 600, 200, 201, 451, 455, 460, 581.1, 581.2, 513, 514, 511, 512, DIG. 1

[56] References Cited

U.S. PATENT DOCUMENTS

| | | | |
|---|---|---|---|
| 3,272,436 | 9/1966 | Hunter | 239/513 |
| 4,579,285 | 4/1986 | Hunter | 239/457 |
| 4,834,292 | 5/1989 | Dyck | 239/DIG. 1 |
| 5,322,223 | 6/1994 | Hadar | 239/457 |
| 5,556,036 | 9/1996 | Chase | 239/457 |
| 6,019,295 | 2/2000 | McKenzie | 239/451 |

*Primary Examiner*—Andres Kashinikow
*Assistant Examiner*—Dinh Q. Nguyen
*Attorney, Agent, or Firm*—Kelly Bauersfeld Lowry Kelley, LLP

[57] ABSTRACT

A variable arc spray nozzle is provided for delivering irrigation water to a surrounding terrain area in a spray pattern of variably adjustable arcuate width. The spray nozzle is adapted for mounting onto the upper end of a water supply riser, and includes a rotatable adjustment collar which cooperates with an upper deflector to define a discharge orifice of variably selected arcuate width. A stabilizer vane on the adjustment collar protrudes generally upstream at the adjustable side edge of the discharge orifice to tailor the associated side edge of the resultant spray pattern for improved water distribution and range. The deflector additionally includes a substantially horizontal step formed at the upstream side of the discharge orifice to produce a localized pressure loss resulting in improved water distribution across the variable width of the spray pattern. This horizontal step leads to a radially outwardly inclined deflector surface which is interrupted by a substantially vertical step at the downstream side of the discharge orifice for increasing the trajectory and range of throw for the discharged water stream.

21 Claims, 5 Drawing Sheets

VARIABLE ARC SPRAY NOZZLE

BACKGROUND OF THE INVENTION

This invention relates generally to irrigation sprinkler devices of the type including a spray nozzle through which irrigation water is delivered in a selected spray pattern to a surrounding terrain area, wherein the arcuate width of the selected spray pattern is variably adjustable. More particularly, this invention relates to an improved variable arc spray nozzle for providing a stream or spray of irrigation water to a target terrain area with increased range and improved uniformity of water distribution.

Sprinkler spray heads or spray nozzles are well known in the art, of the type adapted for mounting onto the upper end of a fixed or pop-up water supply riser and including at least one discharge orifice shaped to distribute irrigation water in a stream or spray pattern of selected arcuate width to surrounding vegetation such as turf grass, shrubs and the like. In one common form, such spray nozzles are manufactured from relatively economical plastic to include an upper deflector assembled with a lower nozzle body for mounting onto a water supply riser, wherein the deflector and nozzle body cooperatively define the discharge orifice of selected arcuate span through which the water stream or spray is projected outwardly. Such spray nozzles are normally produced in a several standard models to respectively provide, for example, a quarter-circle, half-circle, three-fourths-circle, and full-circle spray patterns. In a typical irrigation system installation employing a plurality of spray nozzles for collectively irrigating a terrain field, a combination of different spray nozzles models are used at different locations throughout the terrain field to insure that irrigation water is distributed over the intended area, substantially without spraying water onto unintended areas such as walkways and roadways.

In many instances, however, the specific geometry of the terrain area to be irrigated has a non-standard configuration, particularly along the sides or edges of a terrain field to be irrigated, wherein use of a standard model spray nozzle will result in the delivery of irrigation water onto unintended areas or alternately will result in a spray pattern of insufficient arcuate width to irrigate the desired terrain area. To avoid water waste or inadequate irrigation of vegetation in such non-standard applications, so-called variable arc spray nozzles have been developed for providing a customized water stream or spray pattern of adjustably selected arcuate width. Such variable arc nozzles include a discharge orifice defined in part by a rotatable adjustment member for selectively re-positioning one side edge of the discharge orifice in a manner to adjust the arcuate width of the resultant water spray pattern within a substantially continuous range of from about 0° to a full-circle pattern. Exemplary variable are spray nozzles are available from Rain Bird Sprinkler Mfg., Corp., of Glendora, Calif. under product designation VAN Series Nozzles. See also U.S. Pat. No. 4,579,285.

While variable arc spray nozzles beneficially permit specific custom setting of the spray pattern arcuate width, the distribution of water to the surrounding terrain from such nozzles has been relatively irregular and non-uniform. More specifically, for any selected spray pattern width, the precipitation rate for the delivery of irrigation water to the target terrain area has tended to be undesirably uneven with some zones receiving substantially more water than others. Moreover, this distribution inconsistency tends to shift in an apparently unpredictable manner as the spray pattern width is increased or decreased. In addition, near the movable side edge of the adjustable width spray pattern as defined by the rotatable adjustment member, the water distribution has a tendency to be particularly non-uniform and indistinctly defined with a significant fall-off in the projected range of throw. These characteristics have limited the commercial acceptance of variable arc spray nozzles.

The present invention relates to an improved variable arc spray nozzle designed for overcoming these problems and disadvantages, particularly with respect to delivering irrigation water in a stream or spray pattern of variably adjustable arcuate width and with a substantially uniform precipitation rate to a surrounding target terrain area.

SUMMARY OF THE INVENTION

In accordance with the invention, an improved variable arc spray nozzle is provided for delivering irrigation water to a surrounding terrain area in a spray pattern of variably adjustable arcuate width. The spray nozzle defines a discharge orifice of variable width to produce an outwardly projected stream or spray of irrigation water having a selectively adjustable arcuate width ranging substantially continuously from about 0° to a full-circle pattern. Throughout the adjustment range, the spray nozzles delivers the irrigation water to the surrounding target terrain area with substantially uniform precipitation rate and range of throw.

In the preferred form, the improved spray nozzle comprises a nozzle body adapted for mounting onto the upper end of a water supply riser. An adjustment collar is rotatably mounted on the nozzle body and cooperates with an upper deflector to define the discharge orifice through which the irrigation water is projected outwardly in the spray pattern of selected arcuate width. The deflector defines one side edge of the discharge orifice, and the adjustment collar defines an opposite movable side edge of the discharge orifice. A stabilizer vane on the adjustment collar protrudes generally upstream at the movable side edge of the discharge orifice to tailor the resultant spray pattern for improved water distribution and range at the side edge of the spray pattern associated therewith.

The deflector includes a substantially horizontal step formed at the upstream side of the discharge orifice to produce a localized pressure loss resulting in improved water distribution across the variable width of the spray pattern. This horizontal step leads to a radially outwardly inclined deflector surface at the downstream side of the discharge orifice, along which the irrigation water is projected at a selected inclination angle to impart a selected trajectory to the spray pattern. This inclined deflector surface is interrupted by a substantially vertical step for increasing the spray pattern trajectory and range of throw.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
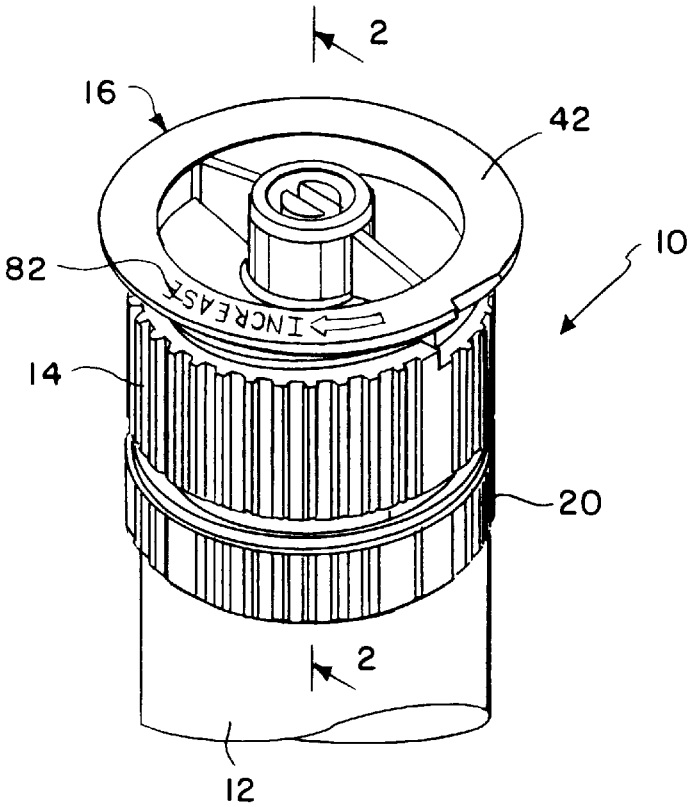
FIG. 1 is a perspective view of an a variable arc irrigation spray nozzle embodying the novel features of the invention.

As shown in the exemplary drawings, an improved variable arc sprinkler spray nozzle is referred to generally in the accompanying drawings by the reference numeral 10 for mounting onto the upper end of a tubular water supply pipe or riser 12. The variable arc nozzle 10 includes a rotatable adjustment collar 14 which is movably set with respect to an overlying deflector 16 to define a discharge orifice 18 (FIGS. 3 and 4) of selected variable width to produce an outwardly projected stream or spray of irrigation water in a spray pattern having an arcuate width within a substantially continuous range of from about 0° to a full-circle spray pattern. In accordance with the invention, the adjustment collar 14 and deflector 16 are designed for improved uniformity of water distribution or precipitation rate over a surrounding terrain area to be irrigated.

Figure 2:
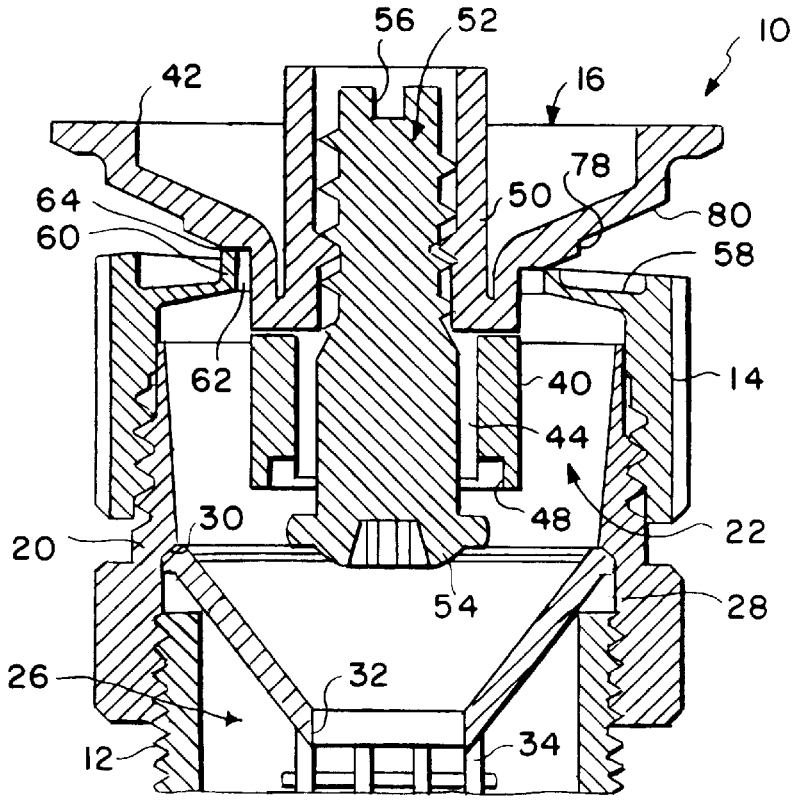
FIG. 2 is an enlarged fragmented vertical sectional view taken generally on the line 2—2 of FIG. 1, and depicting the spray nozzle in a substantially closed position.
Figure 3:
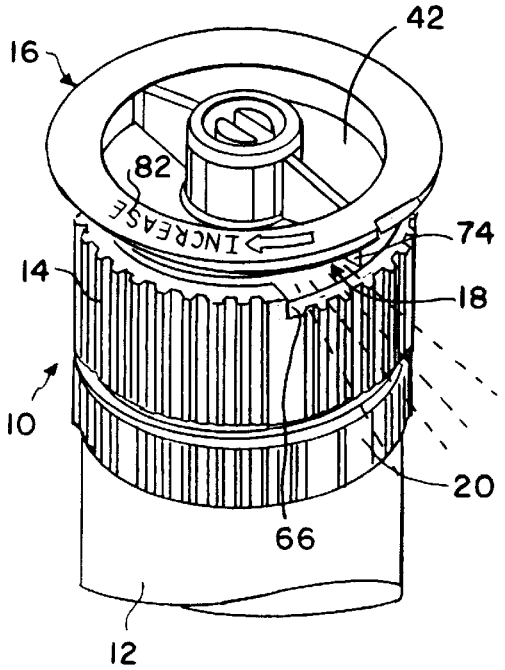
FIG. 3 is a perspective view similar to FIG. 1, but illustrating the spray nozzle set for providing a spray pattern of relatively narrow arcuate width.
Figure 4:
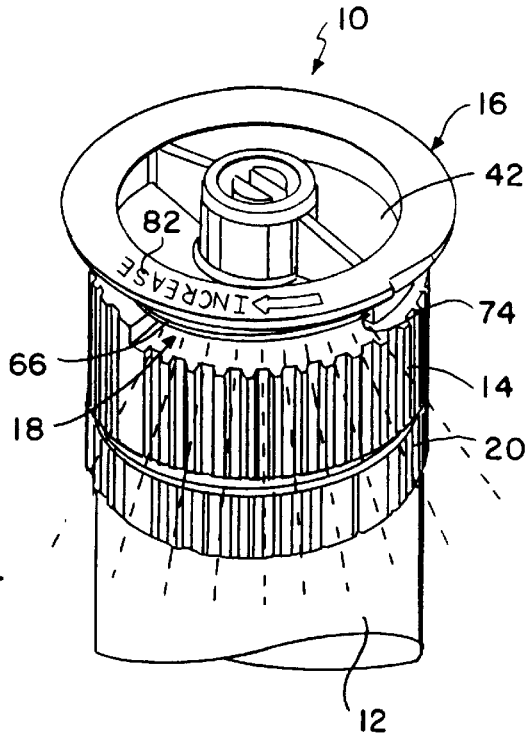
FIG. 4 is a perspective view similar to FIG. 3, but showing the spray nozzle set for providing a spray pattern of comparatively increased arcuate width.
Figure 5:
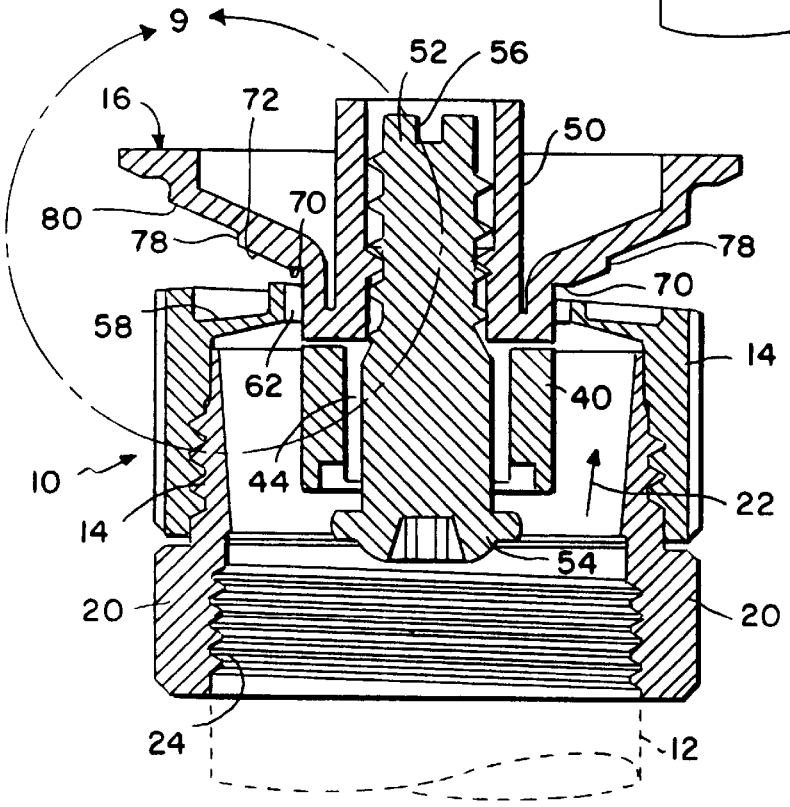
FIG. 5 is an enlarged fragmented vertical sectional view of the spray nozzle similar to FIG. 2, but showing the spray nozzle in an open position for providing a substantially full-circle spray pattern.
Figure 9:
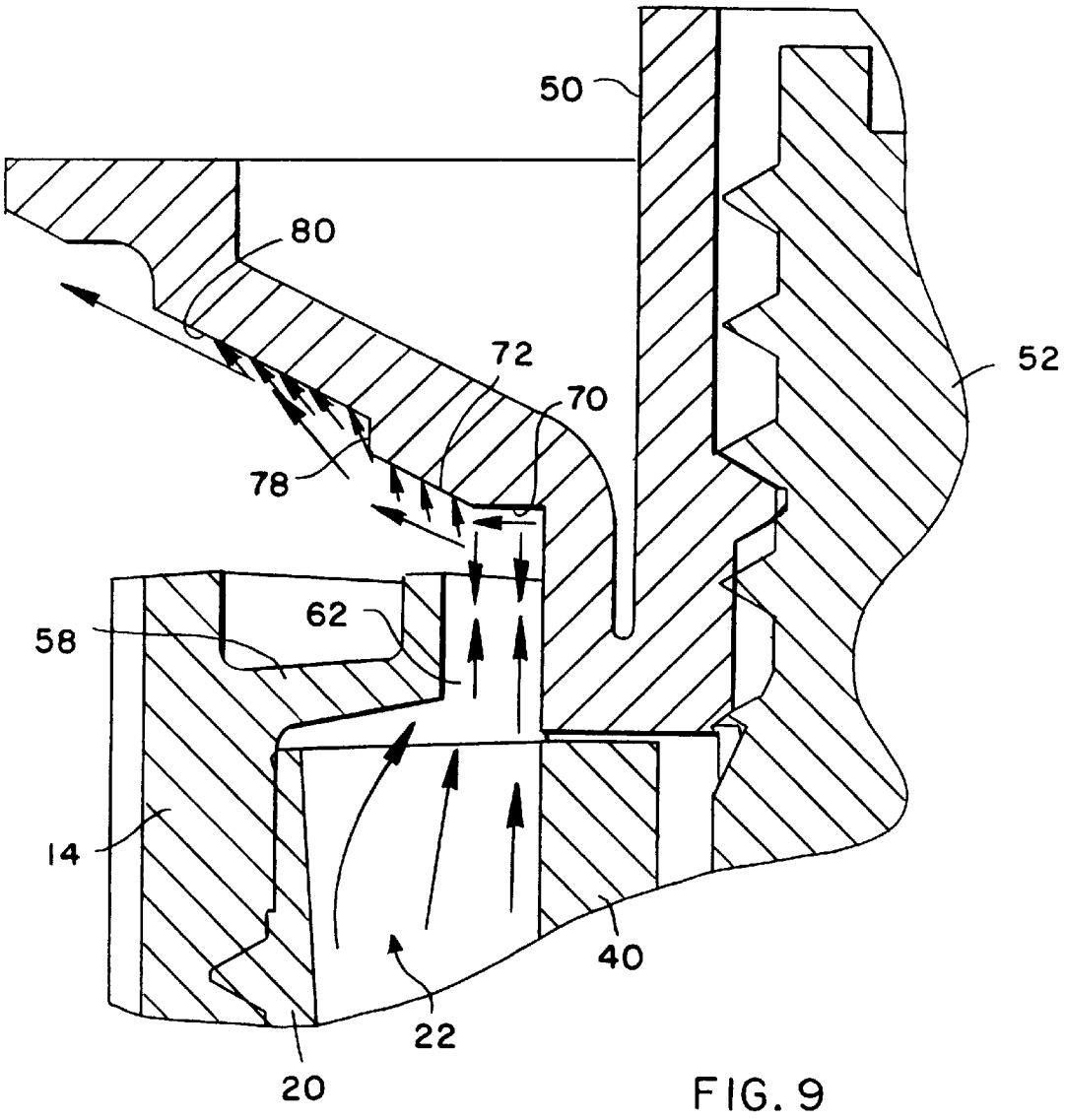
FIG. 9 is an enlarged fragmented vertical sectional view of a portion of the spray nozzle, corresponding with the encircled region 9 of FIG. 5.

The sprinkler spray nozzle 10 generally comprises a lower nozzle body 20 assembled with the upper deflector 16 and the rotatable adjustment collar 14, wherein these components can be formed conveniently and economically from lightweight molded plastic or the like. The nozzle body 20 defines an internal flow path 22 (FIGS. 2, 5 and 9) for passage of water under pressure from the riser 12 to the variable width discharge orifice 18 defined cooperatively by the deflector 16 and adjustment collar 14. FIGS. 1 and 2 show the adjustment collar 14 rotated to a substantially closed or 0° position relative to the deflector 16 to prevent water outflow from the nozzle 10, whereas FIGS. 3 and 4 illustrate the adjustment collar 14 in different rotational open settings to provide outwardly projected streams or sprays of irrigation water shown respectively in the form of spray patterns having an arcuate width of about 30° (FIG. 3) and about 90° (FIG. 4).

The nozzle body 20 has a generally cylindrical configuration to include an internally threaded lower end 24 for mounting onto an externally threaded upper end of the water supply riser 12, wherein the riser 12 may be a fixed-type riser or alternately may comprise a pop-up riser mounted in a normal retracted position within a sprinkler housing (not shown). As shown best in FIG. 2, an inlet rock screen 26 is normally provided within the nozzle body, with an outwardly radiating flange 28 seated between the axial upper end of the riser 12 and an inwardly radiating shoulder 30 formed within the nozzle body 20. A central region of the rock screen 26 defines an inflow port 32 for regulating water inflow to the spray nozzle 10, as will be described in more detail. This inflow port 32 is bridged by a perforated filter element 34 for capturing sizable water-borne debris such as pebbles and the like wherein such debris could otherwise become trapped within the nozzle orifice 18 to interfere with water delivery through the spray nozzle to a surrounding terrain area.

Figure 6:
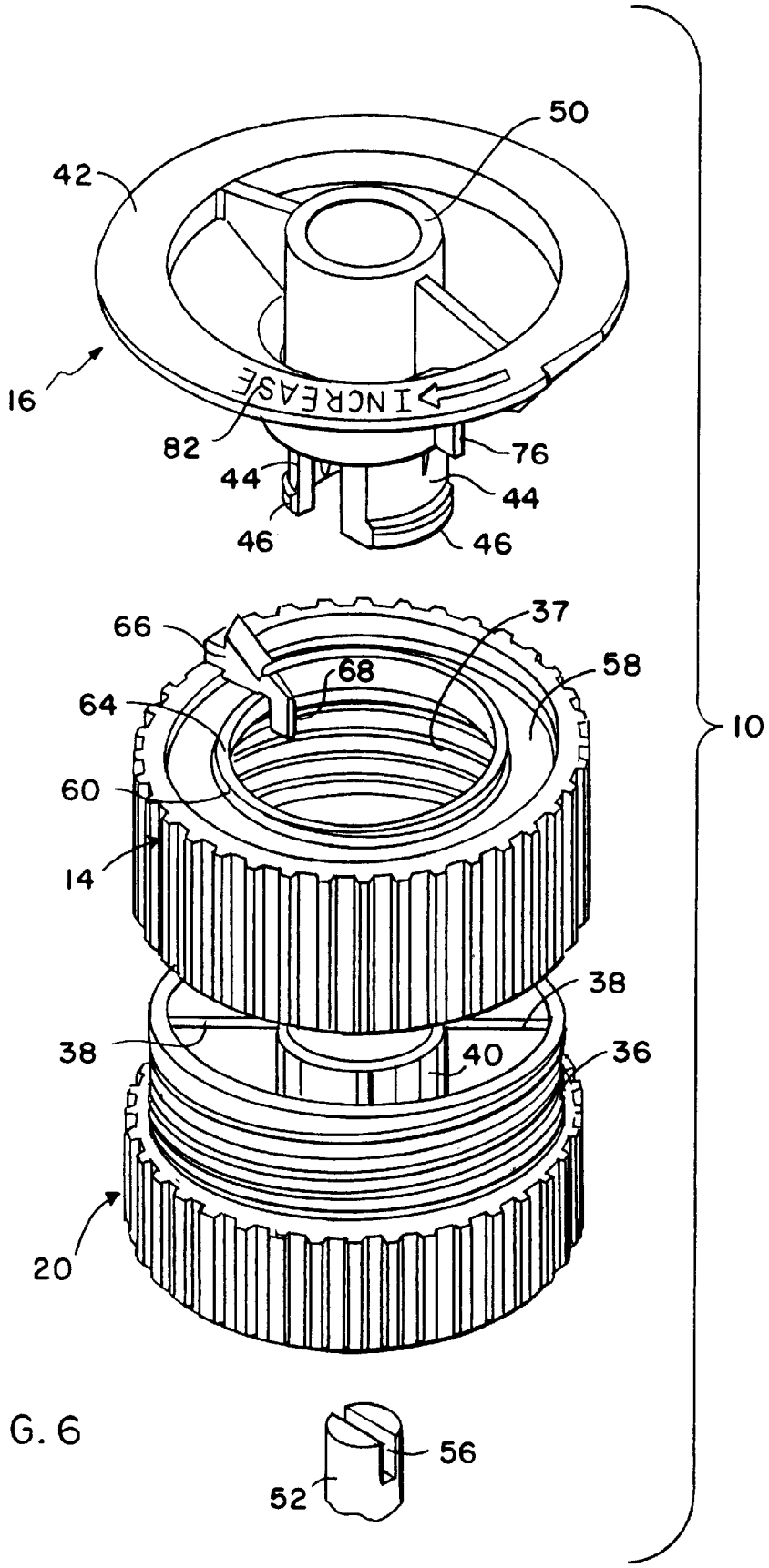
FIG. 6 is an enlarged and exploded perspective view illustrating assembly of the spray nozzle components.
Figure 7:
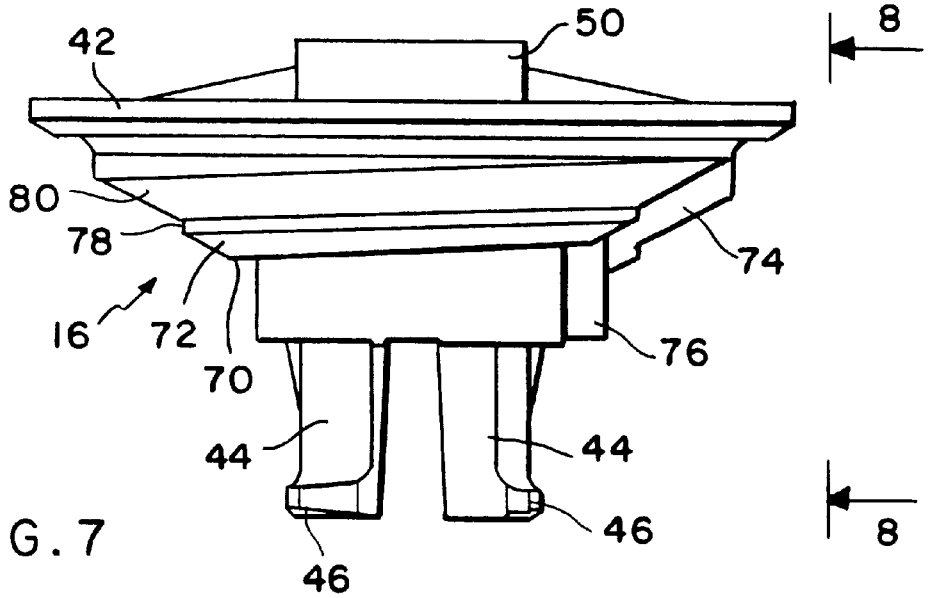
FIG. 7 is a left side elevation view of an upper deflector forming a portion of the spray nozzle.
Figure 8:
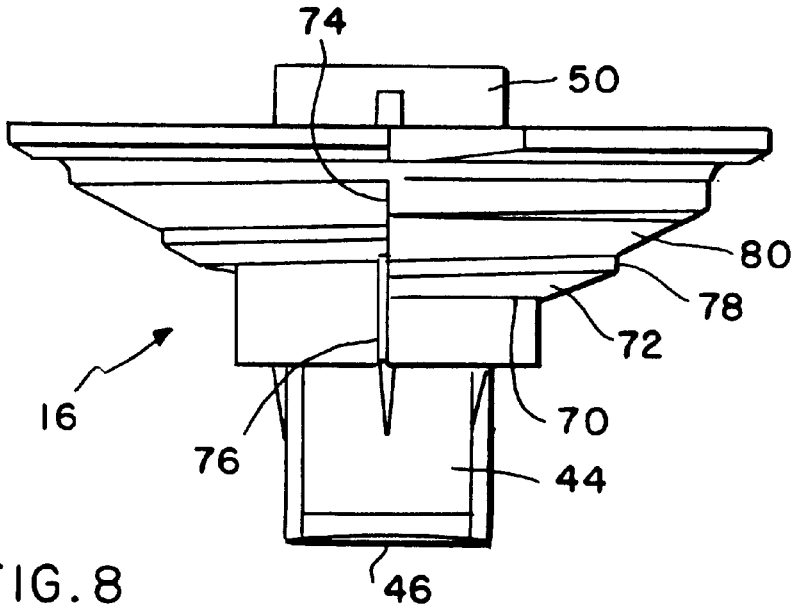
FIG. 8 is a front elevation view of the deflector, taken generally on the line 8—8 of FIG. 7.

An upper region of the nozzle body 20 is externally threaded as indicated by reference numeral 36 (shown best in FIG. 6) to accommodate thread-on mounting of the adjustment collar 14 having an internal thread 37 formed therein. In addition, radially inwardly extending web arms 38 (FIG. 6) are also formed within an upper region of the nozzle body 20 to support a coaxially positioned central support sleeve 40 having a size and shape for snap-fit assembly with the deflector 16. In this regard, the deflector 16 comprises an upper disk 42 of generally circular and upwardly dished configuration, with a pair of downwardly protruding and spaced-apart lock legs 44 for pressed reception through the central support sleeve 40. As shown in FIGS. 6–8, the lowermost ends of these lock legs 44 carry outwardly protruding snap feet 46 for snap-fit and substantially locked reception into undercut notches 48 (FIGS. 2 and 4) formed in the lower end of the support sleeve 40 to lock the deflector 16 against rotation relative to the nozzle body 20. Alternately, after this snap-fit component assembly, the deflector 16 may be secured nonrotationally to the nozzle body 20 by sonic weld attachment or the like to the support sleeve 40.

The deflector 16 additionally includes an internally threaded hollow central boss 50 for seating upon the support sleeve 40 of the underlying nozzle body 20, when the lock legs 44 are snap-fit connected with the support sleeve. A throttling screw 52 is threadably received into this central boss 50 for regulating water inflow to the spray nozzle 10. More particularly, the throttling screw 52 has a lower head 54 in proximity with the inflow port 32 (FIG. 2) formed in the rock screen 26, and a slotted upper end 56 exposed at the upper side of the deflector disk 42 to permit adjustable translation of the head 54 relative to the inflow port 32 to regulate water inflow to the spray nozzle 10 in a manner known to persons skilled in the art.

The adjustment collar 14, rotatably mounted onto the nozzle body 20, includes an upper end wall 58 of generally annular shape extending radially inwardly a short distance over the top of the nozzle body. As shown in FIGS. 2, 5, 6 and 9, this end wall 58 terminates at an axially upwardly extending seal lip 60 which is spaced radially outwardly from the deflector boss 50 to define an annular channel 62 for water flow therebetween. From the underlying flow path 22 Importantly, the seal lip 60 defines an axially upwardly presented seal seat 64 having a spiral shape formed in a single turn to substantially match the lead or pitch angle of the meshed threads 36 and 37 formed respectively on the nozzle body 20 and adjustment collar 14. As shown best in FIG. 6, the opposite ends of this spiral seal seat 64 are separated by an axially extending flat or stop 66. In accordance with one aspect of the invention, the radially inner end of this axial stop 66 carries a short rudder-like stabilizer vane 68 which projects from the end wall 58 in a downward or axially upstream direction into the annular channel 62.

The spiral seal seat 64 on the adjustment collar 14 cooperates with a matingly shaped spiral deflector surface formed on the underside of the deflector disk 42 to form the upper and lower marginal edges of the discharge orifice 18. More specifically, as shown in FIGS. 2, 5 and 7–9, the underside of the deflector disk 42 includes a short and substantially horizontal annular step 70 of single turn spiral shape projecting radially outwardly from the central boss 50, in a direction substantially normal to upward water flow through the underlying channel 62. The spiral step 70 merges with an inner deflector segment 72 which extends radially outwardly therefrom with a selected angle of inclination. Importantly, the inner deflector segment 72 is radially positioned for engagement at an inner peripheral region thereof with the underlying seal seat 64 on the adjustment collar 14. In this regard, the inner deflector segment 72 is also formed with a single turn spiral shape matching the underlying seal seat 64, with the opposite ends thereof being separated by an axially extending flat or stop 74 (FIGS. 6–8) which may also include a rudder-like stabilizer vane 76 projecting from the deflector surface in a downward or axially upstream direction into the annular channel 62.

The inner deflector segment 72 merges at its radially outward periphery with a short and substantially vertical annular step 78 which provides a transition to an outer deflector segment 80. As shown, the vertical step 78 and the outer deflector segment 80 also have a single turn spiral configuration, with the outer deflector segment 80 extending radially outwardly with a selected angle of inclination shown in the illustrative embodiment as matching the inclination angle of the inner deflector segment 72. The opposite ends of the spiral vertical step 78 and the outer deflector segment 80 are bridged by a continuation of the axially extending stop 74.

In use, the adjustment collar 14 is rotatably positioned about the nozzle body 20 for variably selecting the arcuate width or span of the discharge orifice 18. More particularly, in a closed position to prevent water flow discharge from the spray nozzle 10, the adjustment collar 14 is rotatably set to position the flat or stop 66 (FIG. 6) thereon in abutting engagement with the associated flat or stop 74 on the deflector 16. In this position, the spiral seal set 64 on the adjustment collar 14 is rotated or advanced upwardly relative to the nozzle body 20 into substantially full circle seated and sealed engagement with the inner deflector segment 72 on the deflector 16. In this setting, the angular spacing between the abutting stops 66 and 74 is essentially 0°, wherein this angular spacing defines the arcuate width of the discharge orifice 18.

The discharge orifice 18 is opened to a variably selected arcuate width by rotating the adjustment collar 14 in a clockwise direction relative to the deflector 16, as indicated by the indicia 82 (FIGS. 1, 3 and 4) imprinted on the upper side of the deflector disk 42. Such opening movement translates the stop 66 on the adjustment collar 14 rotationally away from the associated stop 74 on the deflector 16. This part-circle arcuate spacing between the stops 66, 74 opens the discharge orifice 18. In this regard, when the stops 66, 74 are spaced apart, the interposed segments of the underlying seal seat 64 and the overlying inner deflector segment 72 are vertically spaced from each other by a substantially constant increment correlated with the lead or pitch angle of the matching spiral shapes, whereby these structures cooperatively define the open discharge orifice 18. However, for the balance of the nozzle periphery, the spiral-shaped seal seat 64 and inner deflector segment 72 remain in sealed engagement to prevent water flow therethrough. FIG. 3 shows the spray nozzle 10 in a position with the stops 66, 74 spaced apart by about 30° to provide an outwardly projected water stream or spray having a spray pattern width of about 30°. FIG. 4 shows the spray nozzle 10 in a position with the stops 66, 74 spaced apart by about 90° to provide an outwardly projected water stream or spray having a spray pattern width of about 90°.

The stepped geometry of the deflector surfaces on the underside of the deflector 16, in combination with the stabilizer vanes 68 and 76, beneficially provides an improved overall distribution of the irrigation water substantially uniformly throughout the target terrain area, with an improved distance or range of throw. More particularly, the stabilizer vanes 68 and 76 protrude from the discharge orifice 18 in an upstream direction into the annular channel 62, wherein these stabilizer vanes are positioned at the opposite side edges of the discharge orifice and the resultant spray pattern. These stabilizer vanes 68 and 76, especially the vane 68 associated with the movable adjustment collar 14, have been found to tailor the water flow at the side edges of the resultant spray pattern so that the spray pattern exhibits a relatively well-defined and consistent side edge without significant variations in terrain precipitation rate or projected distance of throw.

In addition, the inner horizontal step 70 is formed on the underside of the deflector disk 42 at a location slightly upstream from the discharge orifice 18 defined cooperatively by the seal seat 64 and the inner deflector segment 72. This inner step 70 presents a significant obstruction to water flow passing upwardly through the channel 62 for directional transition flow through the variably open discharge orifice 18. More particularly, the water flow impacts the horizontal step 70 to create a significant localized recirculatory flow and related flow turbulence with a resultant localized pressure loss before re-directing for passage outwardly through the orifice 18. This localized pressure loss at the upstream side of the discharge orifice 18 has been found to enhance the overall uniformity of water distribution throughout the resultant spray pattern and the target terrain area.

From the inner horizontal step 70, the water flow passes through the discharge orifice 18. The water flow exhibits a sufficient vertical velocity vector to flow along the inclined inner deflector segment 72 for projection from the spray nozzle 10 in a radially outward direction with a trajectory angle and resultant design range of throw related to the angle of inclination of the segment 72. In accordance with a further aspect of the invention, the water flow transitions to the outer vertical step 78 which provides elevates the angle of trajectory and increases the stream velocity prior to water flow passage along the inclined outer deflector segment 80 and outward projection from the spray nozzle. This combination of outer surfaces including the vertical step 78 and the inclined outer deflector segment 80 have been found to provide an increase to the range of throw of the projected water stream, wherein the improved distance offsets any range reduction attributable to the localized pressure loss encountered at the inner horizontal step 70.

The improved variable arc spray nozzle 10 of the present invention thus provides a discharge orifice 18 and a resultant water spray pattern which can be selectively adjusted substantially continuously between 0° and a full-circle pattern setting, while providing a highly uniformly distributed water precipitation rate over a target terrain area and with highly consistent range of throw for any selected pattern width setting.

A variety of further modifications and improvements in and to the variable arc spray nozzle of the present invention will be apparent to those persons skilled in the art. Accordingly, no limitation on the invention is intended by way of the foregoing description and accompanying drawings, except as set forth in the append claims.

What is claimed is:

1. A variable arc spray nozzle, comprising:

a tubular nozzle body adapted for coupling to a supply of water under pressure;

first and second nozzle members carried by said nozzle body and cooperatively defining opposite side edges of a discharge orifice for radially outward projection of water from the spray nozzle, said first nozzle member being movable with respect to said second nozzle member for defining a movable side edge of said discharge orifice whereby the arcuate width of said discharge orifice and a resultant spray pattern of water projected therefrom can be variably adjusted;

said first nozzle member including a stabilizer vane projecting upstream from said discharge orifice at said movable side edge thereof for tailoring the water distribution and range of throw of the resultant spray pattern at one side edge thereof; and one of said first and second nozzle members comprising a deflector defining a substantially horizontal annular inner step disposed at an upstream side of said discharge orifice, an inner deflector segment extending radially outwardly from said inner step with a selected inclination angle, said inner deflector segment merging with a substantially vertical annular outer step disposed at a downstream side of said discharge orifice, and an outer deflector segment extending radially outwardly from said outer step with a selected inclination angle.

2. The variable arc spray nozzle of claim 1 wherein said second nozzle member comprises said deflector.

3. The variable arc spray nozzle of claim 1 wherein said first nozzle member comprises an adjustment collar rotatably mounted on said nozzle body.

4. The variable arc spray nozzle of claim 3 wherein said adjustment collar and said nozzle body include intermeshed threads having a selected lead angle, and further wherein said adjustment collar includes a seal lip formed in a single turn spiral shape with a lead angle conforming with the lead angle of said intermeshed threads, and further wherein said second nozzle member comprises said deflector, said inner deflector segment on said deflector being formed in a single turn spiral shape with a lead angle conforming with said seal lip.

5. The variable arc spray nozzle of claim 4 wherein said adjustment collar further includes an axially extending stop connected between the opposite ends of said spiral seal lip.

6. The variable arc spray nozzle of claim 5 wherein said stabilizer vane on said adjustment collar projects from said stop in a direction upstream from said discharge orifice.

7. The variable arc spray nozzle of claim 4 wherein said inner step, said outer step, and said outer deflector segment on said deflector are also formed in a single turn spiral shape.

8. The variable arc spray nozzle of claim 7 wherein said deflector further includes an axially extending stop connected between the opposite ends of each of said inner step, said inner deflector segment, said outer step, and said outer deflector segment.

9. The variable arc spray nozzle of claim 8 wherein said deflector further includes a stabilizer vane projecting from said stop in a direction upstream from said discharge orifice.

10. The variable arc spray nozzle of claim 1 wherein said second nozzle member includes a stabilizer vane projecting upstream from said discharge orifice at said side edge thereof opposite said movable side edge.

11. A variable arc spray nozzle, comprising:

a tubular nozzle body adapted for coupling to a supply of water under pressure;

an adjustment collar rotatably mounted on said nozzle body;

a deflector mounted on said nozzle body above said adjustment collar, said adjustment collar and said deflector cooperatively defining a discharge orifice for radially outward projection of water from the spray nozzle, said adjustment collar being movable with respect to said deflector for movably positioning one side edge of said discharge orifice whereby the arcuate width of said discharge orifice and a resultant spray pattern of water projected therefrom can be variably adjusted;

said adjustment collar further including a stabilizer vane projecting upstream from said discharge orifice at said one side edge thereof; and said deflector defining a substantially horizontal annular inner step disposed at an upstream side of said discharge orifice, an inner deflector segment extending radially outwardly from said inner step with a selected inclination angle, said inner deflector segment merging with a substantially vertical annular outer step disposed at a downstream side of said discharge orifice, and an outer deflector segment extending radially outwardly from said outer step with a selected inclination angle.

12. The variable arc spray nozzle of claim 11 wherein said adjustment collar and said nozzle body include intermeshed threads having a selected lead angle, and further wherein said adjustment collar includes a seal lip formed in a single turn spiral shape with a lead angle conforming with the lead angle of said intermeshed threads, and further wherein said inner deflector segment on said deflector is formed in a single turn spiral shape with a lead angle conforming with said seal lip.

13. The variable arc spray nozzle of claim 12 wherein said adjustment collar further includes an axially extending stop connected between the opposite ends of said spiral seal lip.

14. The variable arc spray nozzle of claim 13 wherein said stabilizer vane on said adjustment collar projects from said stop in a direction upstream from said discharge orifice.

15. The variable arc spray nozzle of claim 12 wherein said inner step, said outer step, and said outer deflector segment on said deflector are also formed in a single turn spiral shape.

16. The variable arc spray nozzle of claim 15 wherein said deflector further includes an axially extending stop connected between the opposite ends of each of said inner step, said inner deflector segment, said outer step, and said outer deflector segment.

17. The variable arc spray nozzle of claim 16 wherein said deflector further includes a stabilizer vane projecting from said stop in a direction upstream from said discharge orifice.

18. The variable arc nozzle of claim 11 where in said inner and outer deflector segments are formed with substantially the same inclination angle.

19. In a variable arc spray nozzle adapted for connection to a supply of water under pressure and including first and second nozzle members cooperatively defining opposite side edges of a discharge orifice for radially outward projection of water from the spray nozzle, wherein said first nozzle member is movable with respect to said second nozzle member for defining a movable side edge of said discharge orifice whereby the arcuate width of said discharge orifice and a resultant spray pattern of water projected therefrom can be variably adjusted, the improvement comprising:

a stabilizer vane projecting upstream from said discharge orifice at said movable side edge thereof for tailoring the water distribution and range of throw of the resultant spray pattern at one side edge thereof.

20. The improvement of claim 19 wherein said second nozzle member includes a stabilizer vane projecting upstream from said discharge orifice at said side edge thereof opposite said movable side edge.

21. In a variable arc spray nozzle adapted for connection to a supply of water under pressure and including first and second nozzle members cooperatively defining opposite side edges of a discharge orifice for radially outward projection of water from the spray nozzle, wherein said first nozzle member is movable with respect to said second nozzle member for defining a movable side edge of said discharge orifice whereby the arcuate width of said discharge orifice and a resultant spray pattern of water projected therefrom can be variably adjusted, the improvement comprising:

one of said first and second nozzle members comprising a deflector defining a substantially horizontal annular inner step disposed at an upstream side of said discharge orifice, and an inner deflector segment extending radially outwardly from said inner step with a selected inclination angle;

said inner deflector segment merging with a substantially vertical annular outer step formed on said deflector and disposed at a downstream side of said discharge orifice, and said deflector further including an outer deflector segment extending radially outwardly from said outer step with a selected inclination angle.

* * * * *